US009248061B2

(12) United States Patent
Koerth et al.

(10) Patent No.: US 9,248,061 B2
(45) Date of Patent: Feb. 2, 2016

(54) MOBILE PATIENT BED

(71) Applicants: Michael Koerth, Fürth (DE); Matthias Müller, Kemnath (DE); Wolfgang Neuber, Pressath (DE); Georg Walberer, Kastl (DE); Kerstin Waldbach, Porstendorf (DE); Paul Weidner, Pressath (DE)

(72) Inventors: Michael Koerth, Fürth (DE); Matthias Müller, Kemnath (DE); Wolfgang Neuber, Pressath (DE); Georg Walberer, Kastl (DE); Kerstin Waldbach, Porstendorf (DE); Paul Weidner, Pressath (DE)

(73) Assignee: Siemens Aktiengesellschaft, München (DE)

( * ) Notice: Subject to any disclaimer, the term of this patent is extended or adjusted under 35 U.S.C. 154(b) by 49 days.

(21) Appl. No.: 14/297,321

(22) Filed: Jun. 5, 2014

(65) Prior Publication Data

US 2014/0359942 A1 Dec. 11, 2014

(30) Foreign Application Priority Data

Jun. 6, 2013 (DE) ..... 10 2013 210 537

(51) Int. Cl.

| | |
|---|---|
| ***A61G 13/06*** | (2006.01) |
| ***A61G 1/02*** | (2006.01) |
| ***A61G 7/012*** | (2006.01) |
| *A61G 7/018* | (2006.01) |

(52) U.S. Cl.

CPC *A61G 1/02* (2013.01); *A61G 7/012* (2013.01); *A61G 13/06* (2013.01); *A61G 7/018* (2013.01); *A61G 2203/70* (2013.01)

(58) Field of Classification Search

CPC ..... A61G 1/02; A61G 2203/70; A61G 7/012; A61G 7/018; A61G 13/06; A47C 20/041; A47C 20/043; A47C 20/046

USPC ..... 5/611, 616

See application file for complete search history.

(56) References Cited

U.S. PATENT DOCUMENTS

| | | | | |
|---|---|---|---|---|
| 2,397,092 | A * | 3/1946 | Drexler et al. | 5/616 |
| 3,012,253 | A * | 12/1961 | Reichert | 5/616 |
| 3,015,113 | A | 1/1962 | Wallen | |
| 4,545,084 | A * | 10/1985 | Peterson | 5/618 |
| 5,095,562 | A * | 3/1992 | Alexander | 5/616 |
| 5,269,031 | A * | 12/1993 | Alexander | 5/616 |
| 2006/0053550 | A1 | 3/2006 | Snyder et al. | |
| 2011/0067179 | A1* | 3/2011 | Klemm et al. | 5/601 |
| 2011/0083272 | A1* | 4/2011 | Childs et al. | 5/616 |

OTHER PUBLICATIONS

German Office Action for German Application No. 10 2013 210 537.1, mailed Oct. 18, 2013, with English Translation.

* cited by examiner

*Primary Examiner* — Michael Trettel

(74) *Attorney, Agent, or Firm* — Lempia Summerfield Katz LLC

(57) ABSTRACT

A mobile patient bed includes a bench that may be moved vertically via a lifting mechanism. Vertical movement may be effected via a first, electric drive mechanism including a drive device that may be operated when connected to an energy supply. As an alternative, vertical movement may be effected via a second drive mechanism that may be actuated by the operator using a foot pedal. The drive device is a drive motor that is coupled to the lifting mechanism via a motor shaft and is coupled to the second drive mechanism via a clutch. The clutch is closed with no connection to the energy supply and is opened with connection established. The motor shaft may be driven via the second drive mechanism when the clutch is closed.

20 Claims, 2 Drawing Sheets

MOBILE PATIENT BED

This application claims the benefit of DE 10 2013 210 537.1, filed on Jun. 6, 2013, which is hereby incorporated by reference in its entirety.

BACKGROUND

The present embodiments relate to a mobile patient bed including a bench that may be moved vertically via a lifting mechanism.

Mobile patient beds are used, for example, in hospitals. Mobile patient beds make it possible for patients to be moved around the hospital and delivered, for example, to a piece of medical examination and/or treatment equipment and the like. The patient bed includes a bench (e.g., a platform) that may be moved vertically via a lifting mechanism in order for the table height to be adjusted and for adaptation to any given location. Such patient beds may be "docked" to a piece of examination and/or treatment equipment (e.g., coupled to this piece of equipment so that the patient lying on the bench, and remaining there, may be examined and/or treated using the examination and/or treatment equipment). An example is such a docking system for coupling the patient bed to a piece of equipment that uses magnetic resonance. The height of the bench may be set accordingly via the lifting mechanism.

As described, a known mobile patient bed has two separate drive mechanisms (e.g., a first, electric drive mechanism including a drive device that may be operated when connected to an energy supply, where this drive mechanism serves for automatic bed adjustment, and a second drive mechanism that is a manual drive mechanism and includes at least one foot pedal that may be actuated by the operator in order to move the bench vertically). In the case of a known patient bed, the entire lifting mechanism (e.g., both the first, electric drive mechanism and the second "manual" drive mechanism) is realized hydraulically. There is a hydraulic circuit with a hydraulic cylinder that executes the actual lifting work. Also provided is an electric pump in the form of an electric drive device. The electric pump, when connected in the docked state to an energy supply provided with the piece of an examination and/or treatment equipment, delivers the hydraulic fluid and, consequently, drives the hydraulic cylinder thereby in order to move the table upward or downward. Additionally provided is at least one foot pedal that makes it possible for the hydraulic fluid to be delivered by pedal movement and for the hydraulic cylinder to be actuated "manually" in this way. The foot pedal acts as or operates a mechanical pump for fluid-delivery purposes. In order to move the bench upward or downward, the foot lever consequently is to be actuated a number of times in order to achieve a mechanical pumping capacity. In order to shift the bench downward, a second foot lever that opens a valve is actuated in order to let hydraulic fluid out of the hydraulic cylinder and to lower the bench.

These two separate and differently operating drive mechanisms make it possible for the bench adjustment, in the "docked" state, to be carried out automatically (e.g., via the first, electric drive mechanism), and with the bench adjustment to be effected, in the "non-docked" state, by actuation of the foot pedal.

The task of realizing the hydraulic circuit involves considerable outlay, since corresponding hydraulic lines and a fluid reservoir are to be provided. In addition, a high level of outlay is required for providing the sealing of the hydraulic system, since, in view of the fact that the patient bed is being used in a clinical environment, the sealing is provided to avoid leakage.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a mobile patient bed that improves on a patient bed of the prior art is provided.

A patient bed includes a drive device that is a drive motor. The drive device is coupled to a lifting mechanism via a motor shaft and is coupled to a second drive mechanism via a clutch. The clutch is closed with no connection to the energy supply and is opened with connection established. The motor shaft may be driven via the second drive mechanism when the clutch is closed.

The patient bed is distinguished in that neither the first drive mechanism nor the second drive mechanism makes any use of a hydraulic system. Rather, both mechanisms operate purely mechanically. An electric drive device is provided as part of the first drive mechanism, in the form of a drive motor that, when the patient bed is coupled to the piece of examination and/or treatment equipment, or also to some other power supply, may be operated accordingly. This drive mechanism is coupled to the lifting mechanism via a corresponding motor shaft. The lifting mechanism is likewise a purely mechanical lifting mechanism (e.g., a spindle mechanism or the like). This provides that the motor shaft (e.g., via a corresponding intermediate transmission) rotates a drive spindle, to which the bench is coupled. Therefore, the bench may be moved up and down via the spindle movement.

Even in the de-energized state (e.g., when the bed is in the non-docked state), this drive motor or the motor shaft thereof drives the lifting mechanism (e.g., the spindle drive) via the second drive mechanism that includes the foot pedal. The second drive mechanism is of purely mechanical design (e.g., the foot pedal is or may be coupled to the motor shaft mechanically in a manner that makes it possible, upon actuation of the foot pedal, for the motor shaft to be rotated, and, via the motor shaft, for the lifting mechanism to be actuated). Since a corresponding mechanical coupling of the foot pedal and drive motor is to be provided, however, only when the bed is in the non-docked state and there is no power supply to the drive motor, one or more of the present embodiments provide a clutch that, in the form of a switchable element, opens or closes the mechanical connection between the motor shaft and foot pedal. The design is such that the clutch, in the docked state (e.g., when the drive motor is coupled to a power supply), is open (e.g., the mechanical connection is open and the foot pedal is uncoupled from the drive motor). As soon as there is no longer any power supply, however, the clutch closes automatically, and the mechanical connection between the foot pedal and drive motor is established. This allows bench movement via the foot pedal. Since the state of the clutch (e.g., open—closed) thus depends on whether the patient bed is docked or is connected up to a power supply, the clutch may be an electrically actuable clutch that therefore uses a power supply for active opening and, in the absence of a power supply, closes automatically.

While fully dispensing with a hydraulic system, the patient bed according to one or more of the present embodiments thus allows automatic bench adjustment when the bed is coupled to a power supply and "manual", albeit purely mechanical, adjustment when the bed is not coupled to a power supply.

In order to make it possible for the bench to be both raised and lowered via the foot pedal, the second drive mechanism may be configured for switching over such that, in a first switching position, upon actuation of the foot pedal, the motor shaft is rotated such that the bench is raised. In a second switching position, upon identical actuation of the foot pedal, the motor shaft is rotated in the opposite direction, and the bench is lowered. This provides that, for vertical movements of the bench, just one foot pedal is to be actuated (e.g., in the same way in each case). The movement direction is realized by a corresponding switchover device that allows the drive mechanism to be switched over such that, depending on the switching position, the same actuation of the foot pedal results in the one case in raising action and in the other case in lowering action. The switchover device varies the appropriate movement coupling to the motor shaft such that, in the one switching position, the motor shaft is rotated in the one direction, which results, for example, in the bench being raised, where, in the other switching position, the motor shaft is rotated in the other direction, which results in the bench being lowered.

In order to change the direction of rotation correspondingly, an advantageous development provides two toothed, arrestable rotary elements (e.g., gearwheels). One gearwheel is coupled to the foot pedal in the first switching position, and the other gearwheel is coupled to the foot pedal in the second switching position. Depending on the movement direction desired, the switchover therefore couples either the one rotary element (e.g., gearwheel) or the other to the foot pedal. Each foot-pedal actuation results in the respectively coupled rotary element being rotated through a certain angle of rotation that is dependent on the pedal displacement and, in turn, results in corresponding stepwise rotation of the motor shaft when the motor shaft is coupled via the clutch.

In order for the respectively coupled rotary element to be actuated, a development provides for each toothed rotary element to be assigned a drive element that engages in the toothing formation and, in the respective switching position, may be moved, via the foot pedal, for stepwise actuation of the respective rotary element. Such an engagement element may be designed in the form of a draw hook that, when coupled to the foot pedal, is drawn by a defined distance.

For further mechanical coupling of the engagement element, the foot pedal is a toggle mechanism that is connected to the engagement element and may be coupled in a releasable manner to the foot pedal. This corresponding releasable coupling between the toggle mechanism and the foot pedal defines the corresponding switching positions (e.g., the corresponding positions assigned to a defined raising movement and a defined lowering movement).

In order to realize the appropriate coupling of the foot pedal to the one rotary element or the other (e.g., in order to realize the two appropriate switching positions), the foot pedal may be connected to a carrier that may be moved, via a user-actuable actuating element, between two positions, in which the foot pedal is coupled to the one toothed rotary element or the other. In other words, this carrier displaces the foot pedal between two positions, where, in the one position, the foot pedal is connected to the one rotary element (e.g., the one gearwheel), and therefore, in this switching position, upon pedal actuation, the bench is raised. In the other switching position, the foot pedal is coupled to the other gearwheel, and therefore, pedal actuation results in the bench being lowered. If, as described above, the toggle mechanism is provided, then the foot pedal is connected to the one toggle mechanism in the one switching position when the carrier is moved into a first position via the actuating element. In the other switching position, when the carrier has been moved into the other position, the foot pedal is connected to the other toggle mechanism.

The carrier may be moved out of the one position into the other position counter to a restoring force. The actuating element, which interacts with the carrier, may be arrested in a releasable manner in at least the other position. In other words, the carrier is ultimately moved into the one position via the restoring element (e.g., the spring that generates the restoring force). From this position, this carrier is to be actively moved into the other position when a change in direction is to take place. The carrier may be arrested in a releasable manner in this second position, and therefore, this position may consequently be assumed permanently, and the actuating element may not be actuated continuously in order to overcome the restoring force. If the arresting action is released, then the carrier is returned automatically again, via the restoring force, into the first position. This return movement takes place in an appropriately damped manner.

The carrier itself may have a ramp-like actuating surface, on which the actuating element (e.g., a pivotable actuating element configured in the form of a second foot pedal) acts. The operator thus treads, for example, on the second foot pedal, which interacts with the ramp-like actuating surface. The pedal pressure correspondingly displaces the carrier, and therefore, the carrier is moved from the first position, in which the first foot pedal is coupled, for example, to the one toggle mechanism, into the second position, in which the foot pedal is coupled to the other toggle mechanism.

Different methods may be used for the two rotary elements (e.g., the two gearwheels) to be coupled or arranged relative to the motor shaft, or to a connecting shaft that guides the same. In the one case, the two rotary elements may be coupled via an angular transmission (e.g., the axis of rotation of the rotary elements is orthogonal to the axis of rotation of the motor shaft or connecting shaft). As an alternative, the two rotary elements may be seated directly on the motor shaft or connecting shaft. In each case, the clutch has been interposed, and therefore, the corresponding uncoupling, described in the introduction, is possible. Depending on the arrangement of the rotary elements or the orientation of the axis of rotation thereof relative to the motor shaft, it is possible for the pedal mechanism to be positioned and/or designed appropriately.

DETAILED DESCRIPTION

Figure 1:
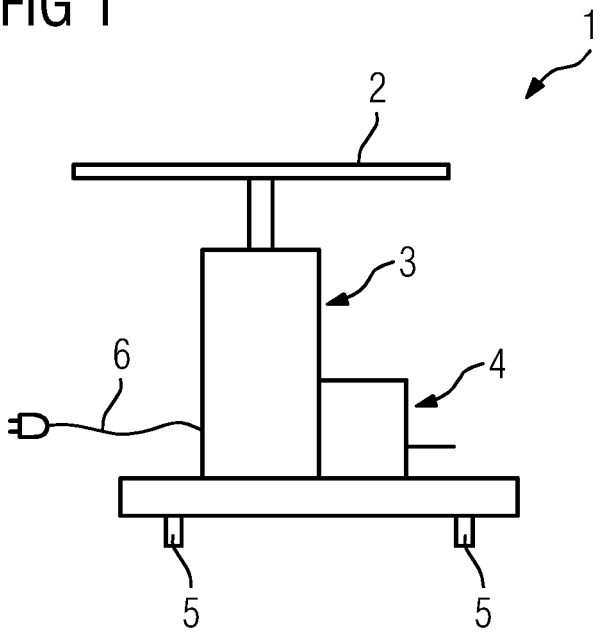
FIG. 1 shows one embodiment of a mobile patient bed.

FIG. 1 shows a mobile patient bed 1, according to one embodiment, including a bench 2 that may be actuated via a lifting mechanism 3 (e.g., a lifting spindle), and a drive unit 4, within which two different drive mechanisms are realized, in order for the bench to be raised and lowered vertically. More detailed discussion of the drive unit 4 will follow herein below. The patient bed 1 may be displaced via rollers 5 and may be docked to a piece of medical treatment and/or therapy equipment (not shown specifically), where the docking action is accompanied by the closure of an electrical connection to an energy supply. This is illustrated, by way of example, by the cable 6. The docking action thus causes this connection to be closed automatically. Such a cable may be provided separately in order to provide attachment to the power supply in the docked state or with the patient bed 1 positioned elsewhere. The power connection is provided since one drive mechanism within the drive unit 4 is an electrically operating drive mechanism that uses a power supply.

Figure 2:
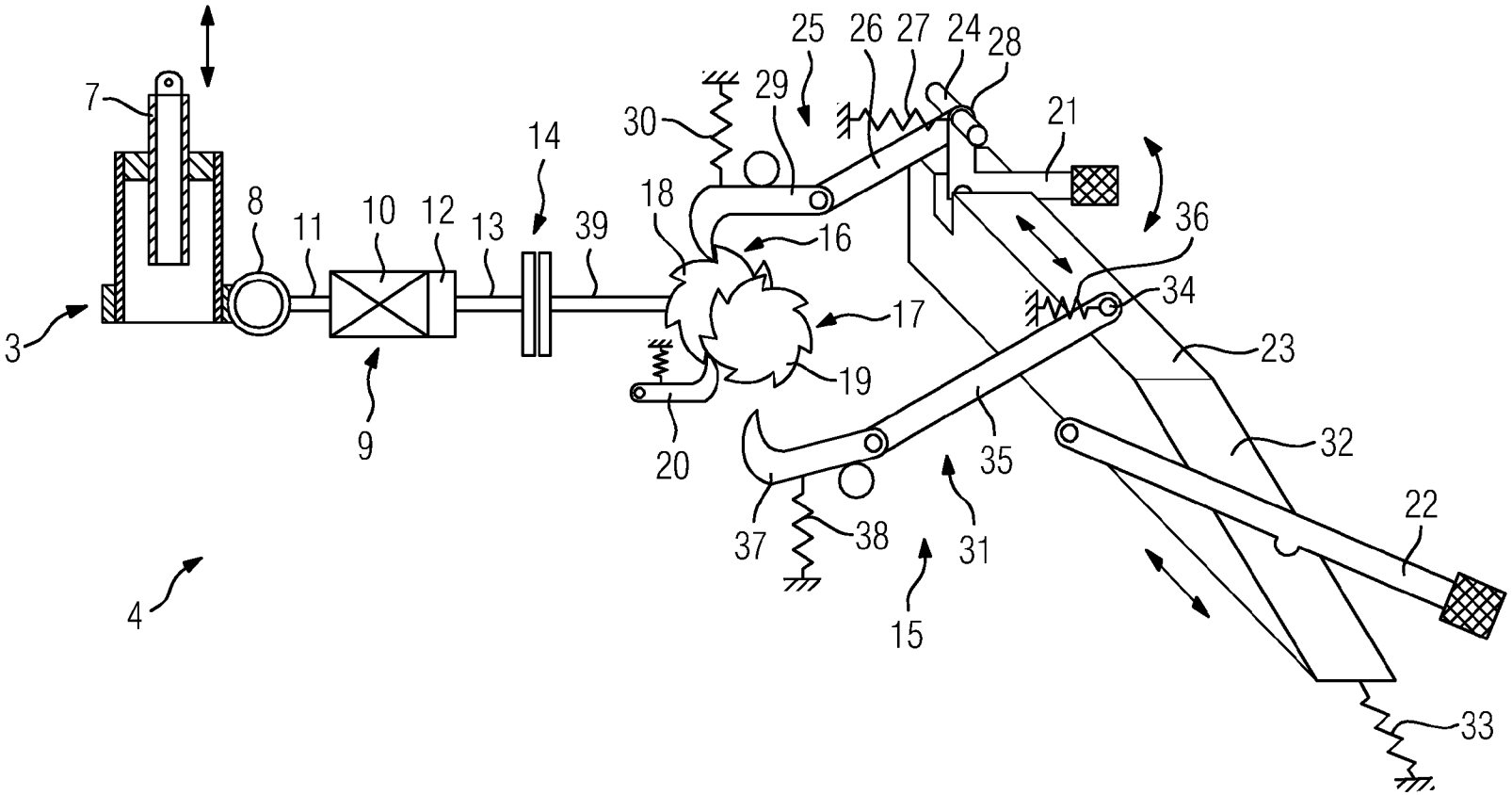
FIG. 2 shows a detailed illustration of one embodiment of the lifting apparatus of the patient bed from FIG. 1.

FIG. 2 shows one embodiment of the lifting mechanism 3 and of the drive unit 4 with the two separate drive mechanisms.

The lifting mechanism 3 includes, for example, a lifting spindle 7 that may be moved vertically, where the lifting spindle 7 is assigned a transmission 8 that is coupled to the lifting spindle 7 mechanically.

The drive apparatus 4 includes a first electric drive mechanism 9 including an electric drive motor 10 that, when coupled to the power supply, is supplied via the connection 6. The motor shaft 11 couples the drive motor 10 to the transmission 8 and the transmission 8 to the lifting spindle 7. Depending on the direction of rotation of the motor 10, the lifting spindle 7 is raised or lowered, and with the lifting spindle 7, the bench 2, which is coupled to the lifting spindle 7. An appropriate actuating device (e.g., actuator, a hand switch or foot switch or the like) is provided for actuation of the drive motor 10. The actuating device is configured such that the different movement directions desired may be selected in a defined manner. The drive motor 10 is assigned a brake 12 that acts on a connecting shaft 13, which continues the motor shaft 11. In the de-energized state (e.g., when the patient bed 1 is not connected to a power supply), the brake is open. In the energized state, the brake is closed, and therefore, the drive motor 10 rotates the motor shaft 11 but not the braked connecting shaft 13, which is coupled to the motor shaft 11 via a freewheel or the like.

The connecting shaft 13 is followed by a clutch 14 that, in the de-energized state (e.g., when there is no power-supply connection), is closed (e.g., a force-fitting connection is established). The clutch 14 is open in the energized state. This makes it possible, when the clutch 14 is open, for the entire movement apparatus of the second, mechanical drive mechanism 15, which is provided on the other side of the clutch, to be uncoupled from the electric drive mechanism 9 (e.g., from the drive motor 10). If, therefore, the power supply is connected, then the clutch 14 is open, and the lifting mechanism 7 is moved exclusively by the drive motor 10. The mechanical drive mechanism 15 is in the uncoupled state and therefore is not usable for the lifting or lowering movement. If the power supply is not connected, the clutch 14 is closed automatically, but the brake 12 is open, and therefore, the mechanical drive mechanism 15 is coupled, via the clutch 14, to the connecting shaft 13 and, via the connecting shaft 13, to the motor shaft 11, which then renders the movement of the lifting spindle 7 possible. Since the power connection is absent, it is not possible, in this case, for the drive motor 10 to be actuated.

On the side that is located opposite the drive motor 10, the clutch 14 is connected to the second, mechanical drive mechanism via a further connecting shaft 39. Two rotary elements 16, 17 (e.g., sawtooth wheels 18, 19) are coupled to the connecting shaft 39. The two sawtooth wheels 18, 19 are shown in side view, and therefore, for example, a corresponding angular transmission is provided for movement-coupling purposes. The two sawtooth wheels 18, 19 rotate about the same axis of rotation, but the two sawtooth wheels 18, 19 are shown in an offset state for the sake of clarity. The first sawtooth wheel 18 is assigned an arresting catch 20 that may be moved counter to the restoring force of a spring element and has a catch portion engaging in the first sawtooth wheel 18 in order to arrest the first sawtooth wheel 18 in the desired position. The second sawtooth wheel 19 may also be assigned such an arresting catch.

The second drive mechanism 15 also includes a first foot pedal 21 and a second foot pedal 22. The first foot pedal 21 may be actuated for raising and lowering action. For this purpose, the first foot pedal 21 is coupled mechanically in a suitable manner either to the first sawtooth wheel 18 or to the second sawtooth wheel 19. In contrast, the second foot pedal 22 serves to effect the "change in direction" (e.g., to effect the respective coupling of the first foot pedal 21 either to the first sawtooth wheel 18 or to the second sawtooth wheel 19).

The first foot pedal 21 is arranged on a carrier 23 such that the first foot pedal 21 may be pivoted about a pivot axis, as is illustrated by the double arrow. The foot pedal 21 includes, on the foot pedal 21, a coupling bolt 24 that projects on either side of the pedal and serves for connecting the foot pedal 21 in a releasable manner to a downstream drawing mechanism, which couples a pedal-pivoting action to one of the sawtooth wheels 18, 19. The one sawtooth wheel 18, 19 is therefore rotated by an angular increment.

In the exemplary embodiment shown, the foot pedal 21 is in a first position, in which the foot pedal 21 is coupled to the drawing mechanism 25 that acts on the first sawtooth wheel 18. This drawing mechanism includes a toggle mechanism 26 that is mounted counter to the restoring force of a spring element 27. The toggle mechanism 26 has, at an end, a through-passage 28, through which, in the example shown, the coupling bolt 24 engages for movement-coupling purposes. Therefore, the foot pedal 21 is coupled to the toggle mechanism 26. The toggle mechanism 26 is connected to a draw hook 29 that has a leading foot end engaging in the toothing formation of the first sawtooth wheel 18.

If, in this switching position, the foot pedal 21 is pushed downward, then the pedal-pivoting action results in the coupling bolt 24 being pivoted to the right, as seen in FIG. 2, which results in the toggle mechanism 26, and via the toggle mechanism 26 the draw hook 29, likewise being drawn some way to the right. As a result, the draw hook 29, which is pushed against the first sawtooth wheel 18 via a spring element 30, causes the first sawtooth wheel 18 to rotate via a defined angular increment dependent on the pedal displacement. This, in turn, results in rotation of the connecting shaft 39 and, via the closed clutch 14, of the second connecting shaft 13, which, since the brake 12 is open, rotates the motor shaft 11. This, in turn, results in the lifting spindle 7 being moved.

If the foot pedal 21 is relieved of loading, then the spring element 27 draws the pedal 21 back into the starting position. The toggle mechanism 26 along with the draw hook 29 is pushed in the opposite direction. As a result of the geometry of the sawtooth wheel 18, the draw hook 30, on reaching the next tooth portion, snaps in, once again, behind the toothing formation, and therefore engages again behind the gearwheel. If the first foot pedal 21 is subjected to pushing action again, this results in further rotation of the sawtooth wheel 18 and in the lifting spindle 7 being moved anew. The position reached by the sawtooth wheel 18 in each case is fixed via the arresting catch 20. This therefore allows the lifting spindle 7 to be extended and the bench 2 to be raised.

If, then, the bench is to be lowered via the mechanical drive mechanism 15, the foot pedal 21 is to be coupled to the second drawing mechanism 31. For this purpose, the second foot pedal 22 is to be raised by the carrier 23, which has a corresponding actuating surface in the form of a ramp 32. The carrier 23 is therefore drawn back via the spring element 33.

This is because, in order to bring the first pedal 21 into the position in which the first pedal 21 is coupled to the first drawing mechanism 25 (shown in FIG. 2), the second foot pedal 22 is subjected to pushing action. The second foot pedal 22 pushes on the ramp 32, via which the carrier 23, which is mounted with sliding action, is moved in the direction of the first drawing mechanism 25 and is put into engagement there, by way of the coupling bolt 24, with the through-passage 28. However, if the second foot pedal 22 is then pushed upward (e.g., relieved of loading), the spring element 33 draws the carrier 23 back again. In the end position, the coupling bolt 24 engages in the through-passage 34 on the toggle mechanism 35 of the second drawing mechanism 31. The toggle mechanism 35 is likewise mounted counter to a spring element 36. The toggle mechanism 35 is connected to a further draw hook 37, which is mounted counter to a spring element 38.

If, then, the first foot pedal 21 coupled in such a way is subjected to pushing action, the second drawing mechanism 31 is drawn to the right. Since the second draw hook 37 then engages with the second sawtooth wheel 19 (e.g., this engagement is ultimately permanent because the respective draw hook 29 or 37, when not active, may always slide over the toothing formation), the second sawtooth wheel 19 is consequently rotatable. Since the second sawtooth wheel 19 is arranged on the same axis as the first sawtooth wheel 18, rotation of the first sawtooth wheel 18 also results, via the angular transmission (not shown), in rotation of the connecting shaft 39 and, via the closed clutch 14, of the connecting shaft 13. Since the brake 12 is open, this rotates the motor shaft 11, which results in the lifting spindle 7 being moved. Since the second sawtooth wheel 19, however, rotates in the opposite direction in comparison to the first sawtooth wheel 18, the lifting spindle 7, then, is moved in the opposite direction. During rotation of the second sawtooth wheel 19, the arresting catch 29 is in the released state. Rotation of the first sawtooth wheel 18 is therefore also possible. If movement of the second sawtooth wheel 19 is at an end, when the foot pedal 21 has been pushed all the way down, then the arresting catch 20 acts on the first sawtooth wheel 18 again and arrests the mechanical drive mechanism 15 as a whole.

If the first foot pedal 21 is relieved of loading again, then the spring element 36 draws the foot pedal 21 into the starting position again. The toggle mechanism 35 and the draw hook 37 are also moved to the left again until the toggle mechanism 35 and the draw hook 37 latch behind the next tooth of the sawtooth wheel 19. Subjecting the foot pedal 21 to pushing action again results in renewed drawing movement and rotation of the second sawtooth wheel 19 by a further angular increment dependent on the pedal displacement.

The present embodiments make it possible for situation-dependent movement of the lifting mechanism 3 to take place using the mechanical drive mechanisms in conjunction with the clutch 14, via which the mechanical drive mechanism 15, depending on whether power connection is or is not established, is or is not coupled to the motor shaft 11. If a power connection is established, then the clutch 14 is open, the mechanical, second drive mechanism 15 is uncoupled, and actuation of the foot pedal 21 does not result in the lifting spindle 7 being moved. Rather, spindle movement takes place via the drive motor 12.

If there is no power connection established, then the clutch 14 is closed, and the mechanical, second drive mechanism 15 is coupled in terms of movement to the motor shaft 11, and thus to the lifting mechanism 3. Any actuation of the foot pedal 21 (e.g., coupled to the first drawing mechanism 25 or coupled to the second drawing mechanism 31) results in a rotary movement of the motor shaft 11 and thus in movement of the lifting mechanism 3. Without any hydraulic components being used, a purely mechanical raising and lowering action may be achieved. Even the operation of switching over between individual movement directions is controlled mechanically.

Although the invention has been illustrated and described in detail by way of the exemplary embodiments, the invention is not restricted by the examples disclosed, and a person skilled in the art may derive other variations therefrom without departing from the scope of protection of the invention.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A mobile patient bed comprising:

a lift;

a first drive and a second drive, the first drive being an electric drive; and a bench that is movable vertically via the lift, wherein the lift is operable to effect vertical movement via the first drive or via the second drive, the first drive operable when connected to an energy supply, the second drive being actuatable by an operator using a foot pedal, and wherein the first drive comprises a drive motor that is coupled to the lift via a motor shaft and is coupled to the second drive via a clutch that, with no connection to the energy supply, is closed and, with connection to the energy supply, is opened, the motor shaft being driveable via the second drive when the clutch is closed.

2. The mobile patient bed of claim 1, wherein the second drive is configured for switching over such that, in a first switching position, upon actuation of the foot pedal, the motor shaft is rotated such that the bench is raised, and that, in a second switching position, upon the same actuation of the foot pedal, the motor shaft is rotated in an opposite direction and the bench is lowered.

3. The mobile patient bed of claim 2, further comprising two toothed, arrestable rotary elements, wherein one of the two toothed, arrestable rotary elements is coupled to the foot pedal in the first switching position, and the other of the two toothed, arrestable rotary elements is coupled to the foot pedal in the second switching position.

4. The mobile patient bed of claim 3, wherein the two toothed, arrestable rotary elements are gearwheels.

5. The mobile patient bed of claim 3, wherein each of the two toothed, arrestable rotary elements is assigned a drive element that engages in a toothing formation and in the respective switching position, is moveable, via the foot pedal, for stepwise actuation of the respective toothed, arrestable rotary element.

6. The mobile patient bed of claim 5, wherein the respective drive element is a draw hook that, when coupled to the foot pedal, is drawn by a defined distance.

7. The mobile patient bed of claim 5, wherein the respective drive element is connected to a toggle mechanism that is coupleable in a releasable manner to the foot pedal.

8. The mobile patient bed of claim 3, wherein the foot pedal is connected to a carrier that is moveable via a user-actuable actuating element, between two positions, in which the foot pedal is coupled to the one toothed, arrestable rotary element or the other toothed, arrestable rotary element.

9. The mobile patient bed of claim 8, wherein the carrier is movable out of one of the two positions into the other of the two positions counter to a restoring force, wherein the user-actuable actuating element, which interacts with the carrier, is arrestable in a releasable manner in at least the other position.

10. The mobile patient bed of 8, wherein the carrier includes at least one ramp-like actuating surface, on which the user-actuable actuating element acts.

11. The mobile patient bed of claim 10, wherein the user-actuable actuating element is pivotable.

12. The mobile patient bed of claim 8, wherein the foot pedal is a first foot pedal, and wherein the user-actuable actuating element is a second foot pedal.

13. The mobile patient bed of claim 3, wherein the two toothed, arrestable rotary elements are coupled to the motor shaft via an angular transmission or are seated directly on a connecting shaft that is coupleable axially to the motor shaft.

14. The mobile patient bed of claim 6, wherein the respective drive element is connected to a toggle mechanism that is coupleable in a releasable manner to the foot pedal.

15. The mobile patient bed of claim 5, wherein the foot pedal is connected to a carrier that is moveable via a user-actuable actuating element, between two positions, in which the foot pedal is coupled to the one toothed, arrestable rotary element or the other toothed, arrestable rotary element.

16. The mobile patient bed of claim 6, wherein the foot pedal is connected to a carrier that is moveable via a user-actuable actuating element, between two positions, in which the foot pedal is coupled to the one toothed, arrestable rotary element or the other toothed, arrestable rotary element.

17. The mobile patient bed of 9, wherein the carrier includes at least one ramp-like actuating surface, on which the user-actuable actuating element acts.

18. The mobile patient bed of claim 9, wherein the foot pedal is a first foot pedal, and wherein the user-actuable actuating element is a second foot pedal.

19. The mobile patient bed of claim 10, wherein the foot pedal is a first foot pedal, and wherein the user-actuable actuating element is a second foot pedal.

20. The mobile patient bed of claim 6, wherein the two toothed, arrestable rotary elements are coupled to the motor shaft via an angular transmission or are seated directly on a connecting shaft that is coupleable axially to the motor shaft.

* * * * *